US005489165A

United States Patent [19]

Smith

[11] Patent Number: 5,489,165

[45] Date of Patent: Feb. 6, 1996

[54] EARTH RETAINER BEAM MODULE AND METHOD

[76] Inventor: David J. Smith, 4488 Candleberry Ave., Seal Beach, Calif. 90740

[21] Appl. No.: 85,560

[22] Filed: Jun. 30, 1993

[51] Int. Cl.[6] ..... E02D 3/02

[52] U.S. Cl. ..... 405/284; 52/169.7; 4/403; 405/258; 405/270

[58] Field of Search ..... 405/270, 284, 405/285, 272, 52; 4/503, 506; 52/169.11, 169.14, 169.7

[56] References Cited

U.S. PATENT DOCUMENTS

| | | | |
|---|---|---|---|
| 118,699 | 9/1871 | Doane | 405/270 X |
| 3,177,501 | 4/1965 | Kwake | 4/503 X |
| 3,444,659 | 5/1969 | Shanni | 52/149 |
| 3,596,296 | 8/1971 | Gertz . | |
| 3,735,427 | 5/1973 | Ancewicz et al. . | |
| 4,008,547 | 2/1977 | Katzman | 52/169.7 |
| 4,064,571 | 12/1977 | Phipps | 4/503 X |
| 4,124,907 | 11/1978 | Laven . | |
| 4,341,051 | 7/1982 | Sim et al. | 52/721 X |
| 5,065,461 | 11/1991 | Shehan et al. | 4/503 |

FOREIGN PATENT DOCUMENTS

| | | | |
|---|---|---|---|
| 878280 | 9/1961 | United Kingdom | 405/270 |

OTHER PUBLICATIONS

Pave Tech, Inc. advertisement for Pave Edge.

Oly–Ola Sales, Inc. advertisement for BRIC–EDG

Oly–Ola Recreational Edgings, Inc. Advertisement for Safety Line Marker/Curbing.

Structure Edge Aluminum Edging advertisement for PERMALOC.

Pool & Spa News, Jun. 7, 1993, advertisement for Middie Garden Pool.

Polynesian Pools, Limited brochure for Middie Garden Pool (1992).

Polynesian Pools Ltd. specification guide for Middie Garden Poll (1992).

Anchor Wall Systems advertisement for Diamond and Windsor Stone.

Jon Charles Coe, Green Walls: New Applications, Landscape Architecture, Jun. 1992.

Swimtech Industries, Inc. advertisement for Pool Panel, 1992 Pool and Spa News p. 423.

Sentry Pool, Inc. advertisement for Bracing Hourglass, 1992 Pool and Spa News p. 425.

*Primary Examiner*—Dennis L. Taylor

*Attorney, Agent, or Firm*—Ronald E. Perez

[57] ABSTRACT

A retaining module for forming a vertical wall for retaining the earth or similar medium from which a pool, pond or stream is to be constructed. The retaining module has a vertical beam and a horizontal beam integrally molded as a single module, or alternatively, separately molded and fastened together. Several such retaining modules are combined with earth retaining blankets and means for anchoring a flexible water tight membrane in the ground to form a substantially permanent and watertight structure to create a pool, pond or stream.

35 Claims, 9 Drawing Sheets

EARTH RETAINER BEAM MODULE AND METHOD

BACKGROUND OF INVENTION

The present invention relates generally to apparatus and methods for retaining earth or a similar medium to be used as part of an in-ground water containment system. More particularly, the present invention is directed to a retaining beam module for use in man-made pools, ponds and streams.

To provide an inexpensive water containment system for koi ponds, water gardens, reservoirs, informal swimming pools, streams and the like, a hole is excavated in the ground and then lined with a continuous sheet of rubber or plastic. As illustrated in FIG. 9, the top perimeter of conventional liner ponds typically has rocks placed on top of the liner at the point where the liner emerges from the ground. The purpose of the rocks is to secure and hide the liner, thereby providing the top edge of the pond a somewhat attractive and relatively realistic appearance. Still, this necklace of rocks is cosmetically undesirable in many applications.

In many applications, the top perimeter of the pool, pond or stream is exposed to frequent foot traffic. Thus, the sides of the structure are subjected to potentially damaging stress and fatigue. One solution known in the prior art is to provide a slope along the sides of the hole to prevent the face of the sides from collapsing into the hole. When building koi ponds and water gardens, however, it is highly desirable to have nearly vertical sides on the ponds for aesthetic reasons, fish safety from predators, and algae control. Existing devices and methods for providing a vertical pond edge, however, have utilized expensive construction techniques.

It is known in the art that in-ground liner ponds with vertical sides may be constructed from fully reinforced and faced walls constructed of pressure treated wood or masonry materials. These walls serve as complete backing or vertical supports for the liners and further serve as earth retaining walls. Similarly, other water containment systems have been constructed from prefabricated vertical panels and braces. The current art utilizes coated zinc galvanized walls that are coated with polymers and use heavy duty steel bracing. Liners are not typically used in this process, but the panels are joined together and coated with a waterproofing liquid which cures in place and subsequently forms the swimming pool. This procedure requires special equipment and is generally too expensive and complicated for the non-professional layperson who wants an inexpensive fish pond.

SUMMARY OF THE INVENTION

The present invention provides an inexpensive apparatus and method for the average home owner or small business person to build an attractive in-ground water containment structure, such as a liner pool, pond or stream with strong, erosion resistant vertical sides. Also, the invention is capable of enhancing present the physical appearance of the water-to-shore transition to be similar to that which might be found in nature. The present invention overcomes the shortcomings of the prior art by providing suitable devices and methods for constructing man-made pools, ponds or streams with a rigid and erosion proof vertical edge without utilizing expensive construction techniques.

The preferred embodiment of the present invention comprises a retaining module for forming a vertical wall for retaining the earth or similar medium from which a pool, pond or stream is to be constructed. The two main structural components of the retaining module are a vertical beam and a horizontal beam.. One manufacturing method is to integrally mold these beams as a single module. The beams, however, can be separately molded components which can be pinned, hinged or similarly fastened together.

The preferred retaining module is further configured with a plurality of holes to assist in the securing and leveling of the vertical and horizontal beams in the earth. In addition, the retaining module is provided with means for securing a retainer blanket and watertight liner which form to the contour of the pool, pond or stream. The retainer module may be manufactured in various sizes and from any suitable material to meet the requirements of a specific application.

The method of the present invention teaches combining several retaining modules to form a substantially permanent and substantially watertight structure to create a pool, pond or stream. The retainer modules may be combined to form a structurally sound and substantially level composite beam. The purpose of the level composite beam is to provide a means of anchoring a flexible water tight membrane in order to build a water storage device such as a pool, pond or stream. Additionally, the level composite beam makes possible the efficient and economical construction of vertical walls. The earth retainer beam module makes for a significant improvement in appearance and results in a higher quality construction at a reduced cost. This improvement is especially noticable with natural looking water gardens and fish ponds.

Other features and advantages of the present invention will become apparent from the following detailed description, taken in conjunction with the accompanying drawings, which illustrate, by way of example, the principles of the invention.

DESCRIPTION OF THE PREFERRED EMBODIMENTS

Figure 1:
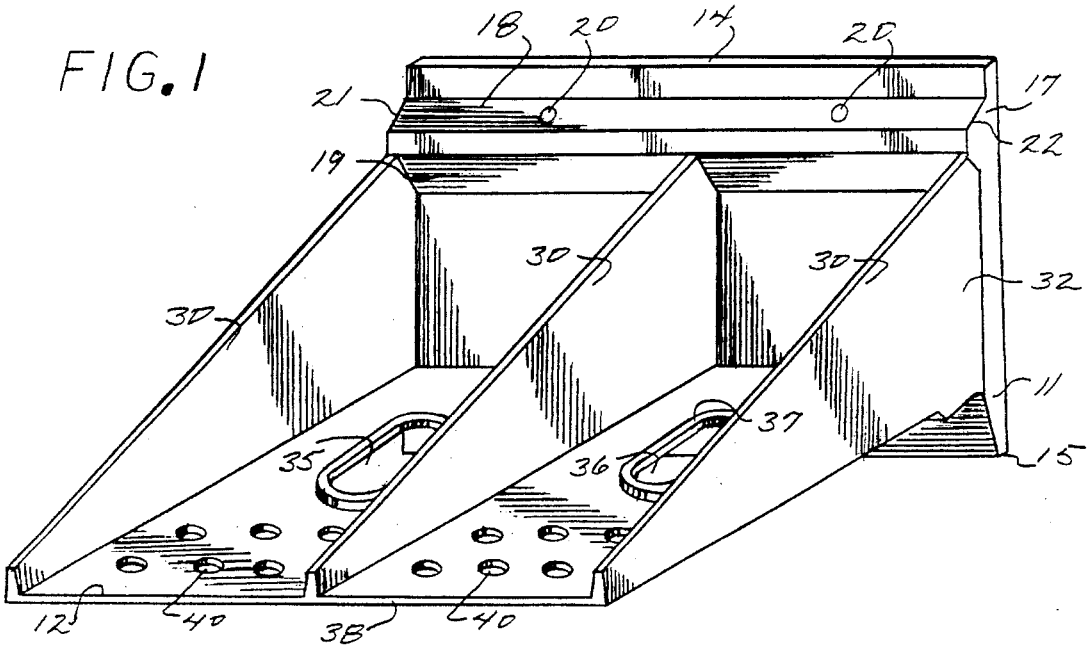
FIG. 1 is a front perspective view of an embodiment of the retaining module of the present invention.

As shown in the drawings for purposes of illustration, the invention is embodied in a earth retaining beam module 10 having two main structural components, namely the vertical beam 11 and the horizontal beam 12. To facilitate easy installation the retaining 7module may be manufactured with the beams integrally molded as one unit. Alternatively, the beams may be separately molded components which can be pinned or similarly fastened together. Since the retaining module is intended for underground use, it is constructed of non-biodegradable construction material. From a strength and cost standpoint the preferred material of construction for the retaining module is injection molded structural polyethylene foam using high density polyethylene (HDPE). The method for manufacturing the retaining module may employ standard injection mold technology or may use reaction injection molding technology, both of which are well known in the art.

Because the retaining module is low cost and easy to install, the present invention allows pools, ponds and streams to be constructed utilizing basic skills and materials available to most any practitioner. In using the techniques of the present invention, the earth or other medium is first excavated to form a trench the desired shape and depth. The retaining modules are then placed within the excavated trench and secured therein. The remainder of the hole is then ecavated. A retainer blanket secured to the retaining module may be placed within the hole to prevent erosion of the sides of the excavation. A water tight seal is obtained by placing a rubber or plastic liner in the excavation and securing the liner to the retaining modules. The remaining construction of the pool, pond, or stream may be completed by conventional methods well known to those of ordinary skill in the art.

Referring now to the drawings, and more particularly to FIG. 1, the retaining module 10 comprises a beam for reinforcing the wall of an excavation. One function of the retaining module is to form a strong vertical bearing surface to hold back earth on one side and to form a bearing area for a liner or water tight membrane on the other side. Another purpose of the retaining module is to provide a means for securing the liner within the excavation to prevent the liner from moving after it has been properly placed. In addition, the retaining module can be curved or stepped about the vertical or horizontal axis of the retaining module to conform to the contour of the excavation.

As illustrated in FIG. 1, the retaining module 10 forms a beam module comprising a vertical beam 11 and a horizontal beam 12. The vertical beam is configured as a rectangular sheet or plate, preferably about sixteen inches wide, extending about eight inches from the top end 14 to the junction with the horizontal beam and extending about two inches from the horizontal beam to the bottom end 15. The vertical beam is made of solid cast polyethylene or high desity polyethylene, utilizing a relatively uniform thickness throughout the rectangular sheet. The vertical beam is preferably 0.5 inches thick from the top end to the juncture with the horizontal beam, and is approximately 0.25 inches thick from the juncture to the bottom end. Other shapes of the vertical plate, besides rectangular, may be used.

Approximately one inch below the top end 14, the vertical beam 11 forms a land 17 having a sloping top face 18 formed at about a 45° downward angle for a distance of approximately one inch. The land comprises a flat register or surface which has been configured for the purpose of mounting a securing means for the liner. The bottom land face 19 formed at about a 45° upward angle, provides a junction face between the vertical beam and the gussets of the horizontal beam 12. The land extends the width of the vertical beam and has one or more land holes 20 approximately 0.75 inch in diameter and 1.5 inches deep. FIG. 1 shows two land holes located about four inches in from the edges 21 and 22 of the land. The purpose of the land holes is to accept threaded brass inserts (not shown) whereby retaining screws may be inserted. Alternatively, the threads may be formed directly into the land holes.

Figure 5:
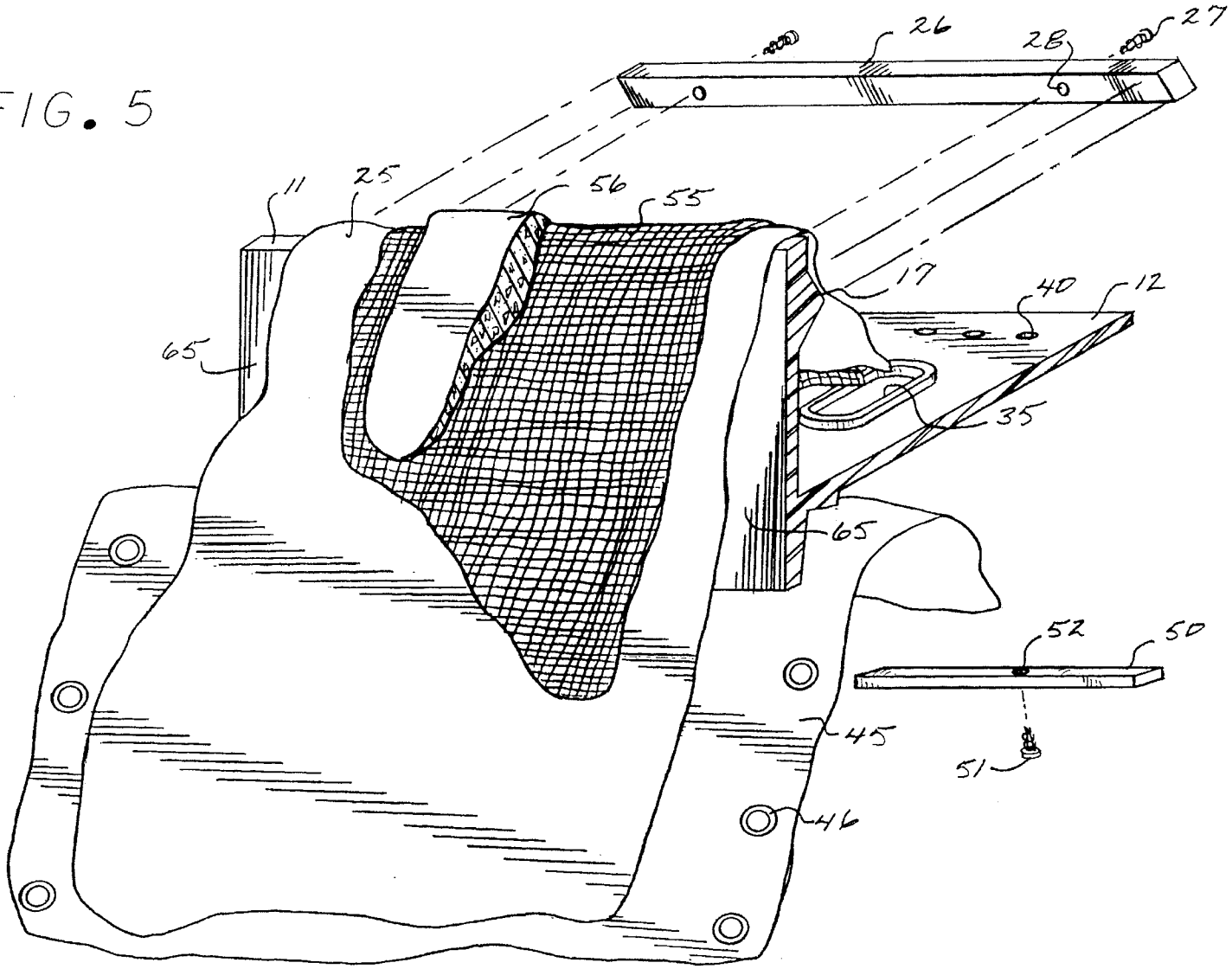
FIG. 5 is a perspective and partial sectional fragmentary view of an embodiment of the present invention illustrating the materials that may be used in the physical installation of the retaining module to form a pool, pond or stream..

As shown in FIG. 5, the land 17 is the bearing or surface area where the liner material 25 is secured to the retainer module 11. A securing means such as batten 26 comprising an elongated rectangular member having batten holes 28 is used to secure the liner to the land. The batten holes are configured so that screws 27 may be fed through the batten holes and liner and then turned down into the land holes 20. The batten 7 is approximately the same length as the width of the vertical beam 11 and as wide as the land top face 18, and about 0.5 inch. The batten is injection molded with the retainer module to minimize cost. Alternatively, other means may be used to secure the liner to the retaining module, such as metal or plastic pins or mechanical clamps.

Figure 2:
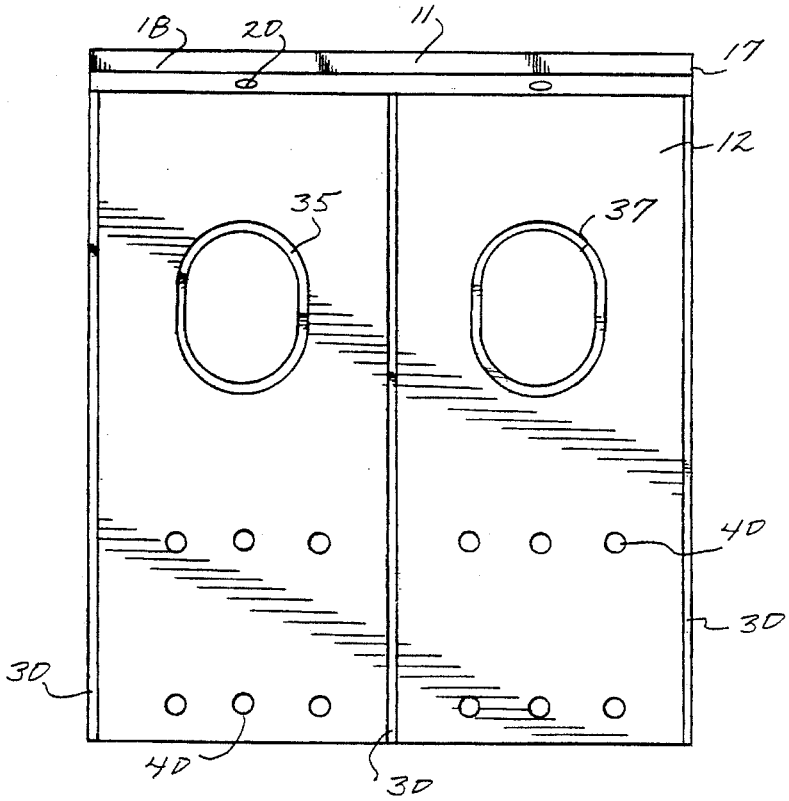
FIG. 2 is a top plan view of the retaining module of FIG. 1.
Figure 3:
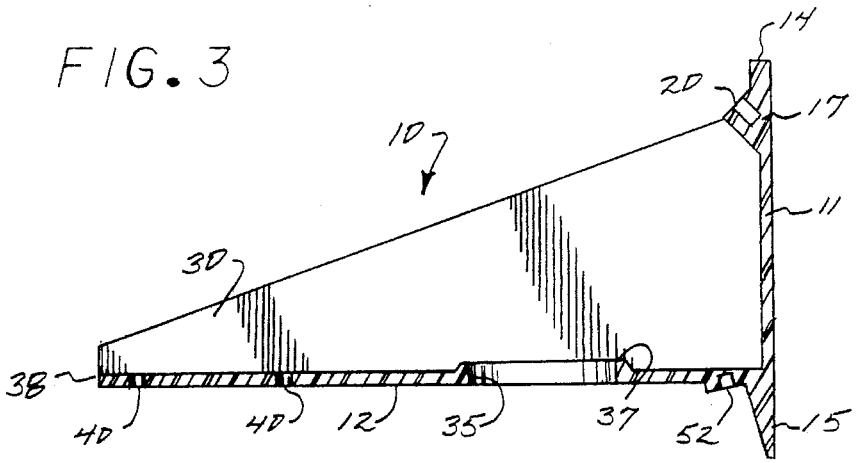
FIG. 3 is a side elevational view of the retaining module of FIGS. 1 and 2.

As shown in FIG. 2, the horizontal beam 12 has a rectangular body configured as a sheet or plate, being the same width as the vertical beam 11 and approximately eighteen inches long. Other shapes of the horizontal plate, besides rectangular, may be used. The preferred minimum thickness of the horizontal beam is 0.25 inches. The body of the horizontal beam is securely held perpendicular to or at a slight downward angle to the vertical beam by a plurality of vertical gussets 30, which are 0.25 inches minimum thickness. In order for these gussets to be de-molded it is advantageous to provide a slight draft or taper from larger at the bottom to smaller at the top, for example, a four degree draft. The first end 31 of the gussets which is furthest from the vertical beam is about one inch high and angles upward towards the vertical beam. As shown in FIG. 3, the second end 32 of each gusset is configured to fit the contour of the surface of the bottom land face 19 to form the juncture with the vertical beam.

Referring to FIG. 2, the horizontal beam 12 has at least one slot 35 molded into the beam, which forms an access hole 36. Each slot is preferably three inches by four inches and has a raised rim 37, 0.25 inches wide and 0.25 inches high, around the peripheral of the slot. The purpose of the raised rim around the slot is to prevent excessive drainage water from entering the access hole. Although it is permissible to have some water introduced under the horizontal beam after the final installation, excessive water should be shed out and away from the excavation. The configuration of the present invention provides superior drainage.

The horizontal beam 12 has a plurality of pinning holes 40 which are molded, punched or drilled into the areas between the vertical gussets. As shown in FIG. 2, a configuration with three gussets 30, having two slots 35 between the gussets, can accommodate six equally spaced 0.5 inch holes centered approximately 1 inch from the open edge 38 and six similarly spaced and sized holes centered approximately 5 inches from the open edge. By means of example, the horizontal beam can also be configured with four equally spaced gussets, allowing for three slots and three sets of pinning holes. Similarly, the number of gussets, slots and pinning holes may be varied to adapt to a specific use.

The horizontal beam 12 serves several functions. The main function of the horizontal beam is to assure that the vertical beam 11 remains fixed in place, regardless of normally expected forces that bear on the retaining module 10 due to heavy rocks, boulders and foot traffic. The gussets 30 serve as reinforcement ribs which extend from the horizontal beam to the vertical beam and provide added strength to the retaining module.

Figure 6:
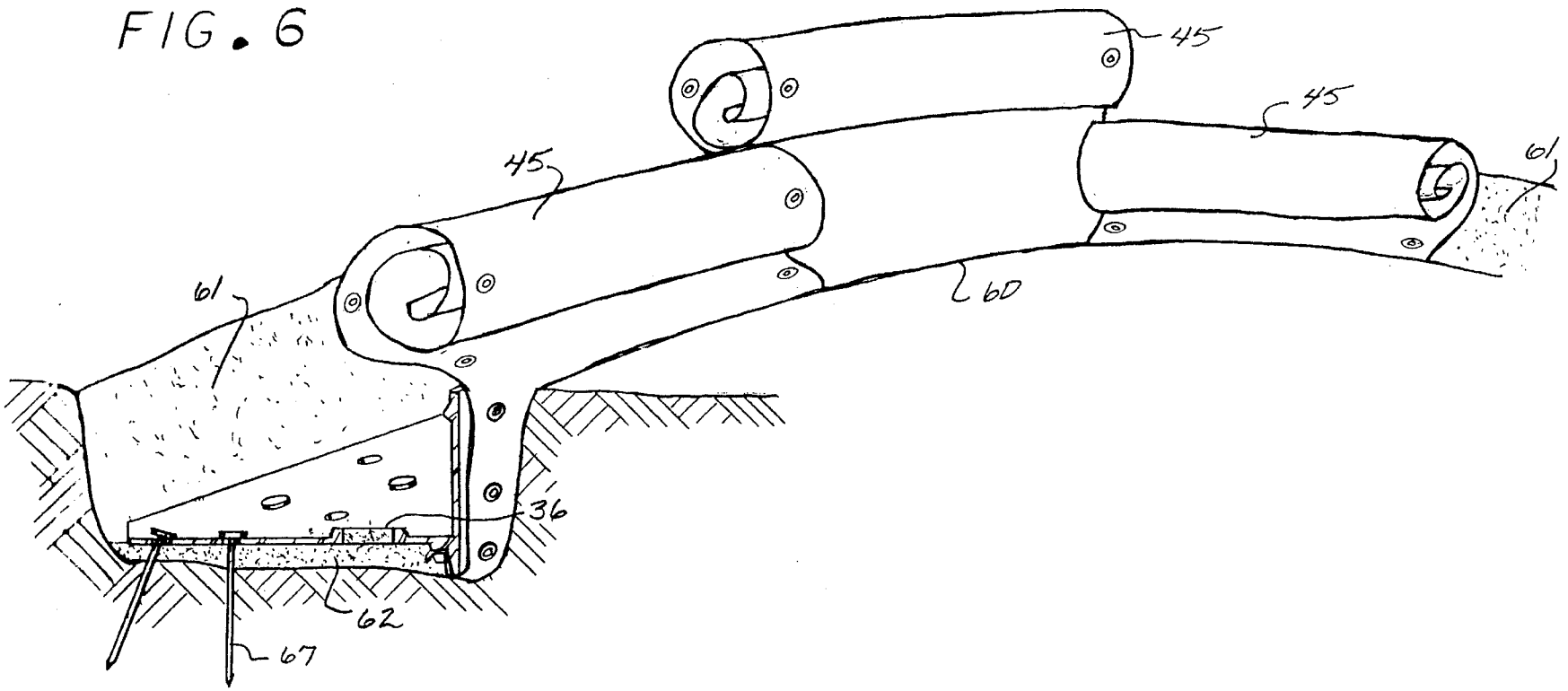
FIG. 6 is a partial sectional view of an embodiment of the retainer module of the present invention shown at an intermediate step during the construction of a pond by the method of the present invention.

Also, the horizontal beam 2 is used as a leveling and positioning aid.. By virtue of its geometry, the horizontal beam ensures that the vertical beam 11 is positioned perpendicular to the surface of the pool, pond or stream. As shown in FIG. 6, aluminum, plastic, or other corrosion and rust resistant spikes, nails or rods may be positioned through the pinning holes 40 for the purpose of securing the horizontal beam in place. The pinning holes or similar auxiliary devices, may also be used to help vertically and horizontally position level the retaining module 10.

Figure 4:
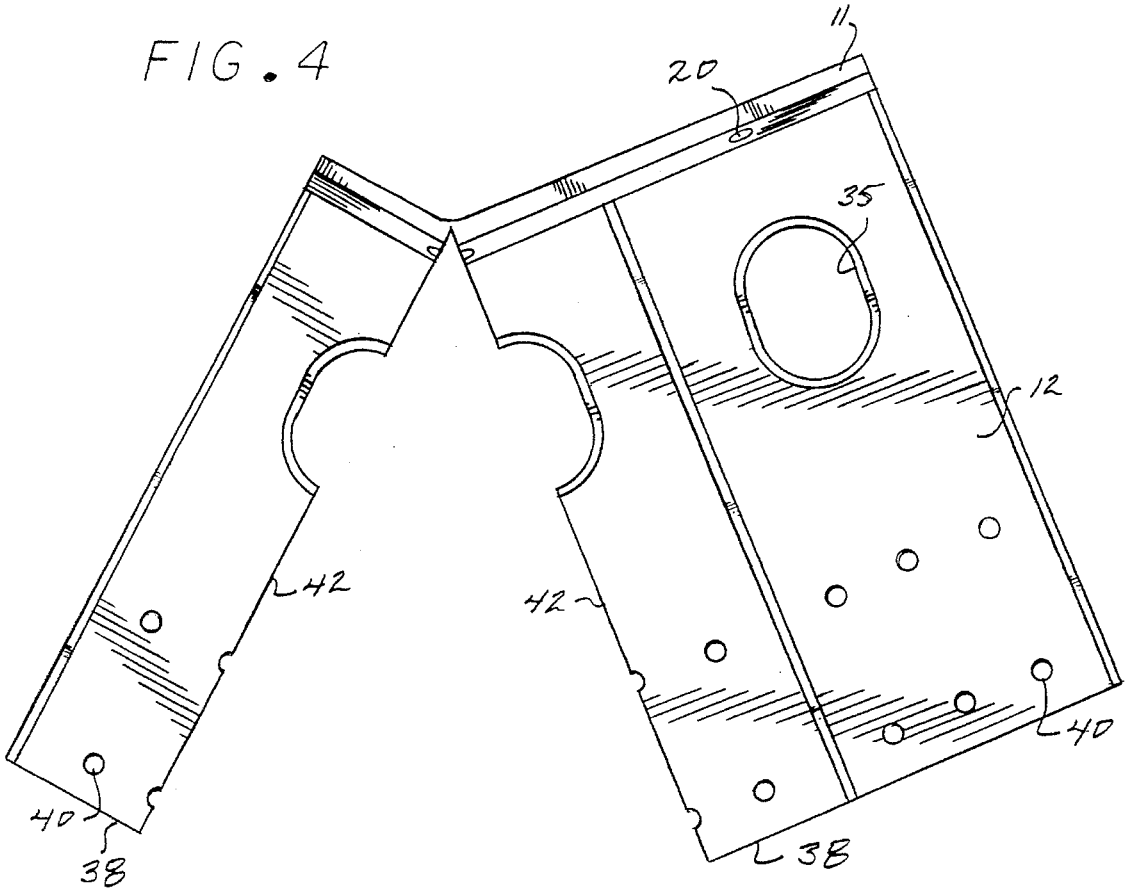
FIG. 4 is a top elevational view of the retaining module of FIGS. 1 and 2, wherein the horizontal beam has been cut to provide a curved vertical beam.

As illustrated in FIG. 4, the horizontal beam 12 can easily be cut or sawed on one or more lines 42 from the open edge 38 of the horizontal beam to the face of the vertical beam 11. The vertical beam can subsequently be bent to form an inside or outside curved section. Conversely, curved retaining modules may be prefabricated or molded to obtained the desired contour of the pool, pond or stream.

As illustrated in FIG. 5, the retainer modules 10 provide a means of attaching and securing a retainer blanket 45 for holding the excavated earth or other medium in place. The retainer blanket may be made of geotextile fabric or similar reinforced non-biodegradable fabric, such as the polyester material used to construct plastic sand bags. Such materials will discourage rodents from burrowing into the walls or floor of a pool, pond or stream. The retainer blanket may be any suitable length and should be at least as wide as a single retaining module.

Figure 7:
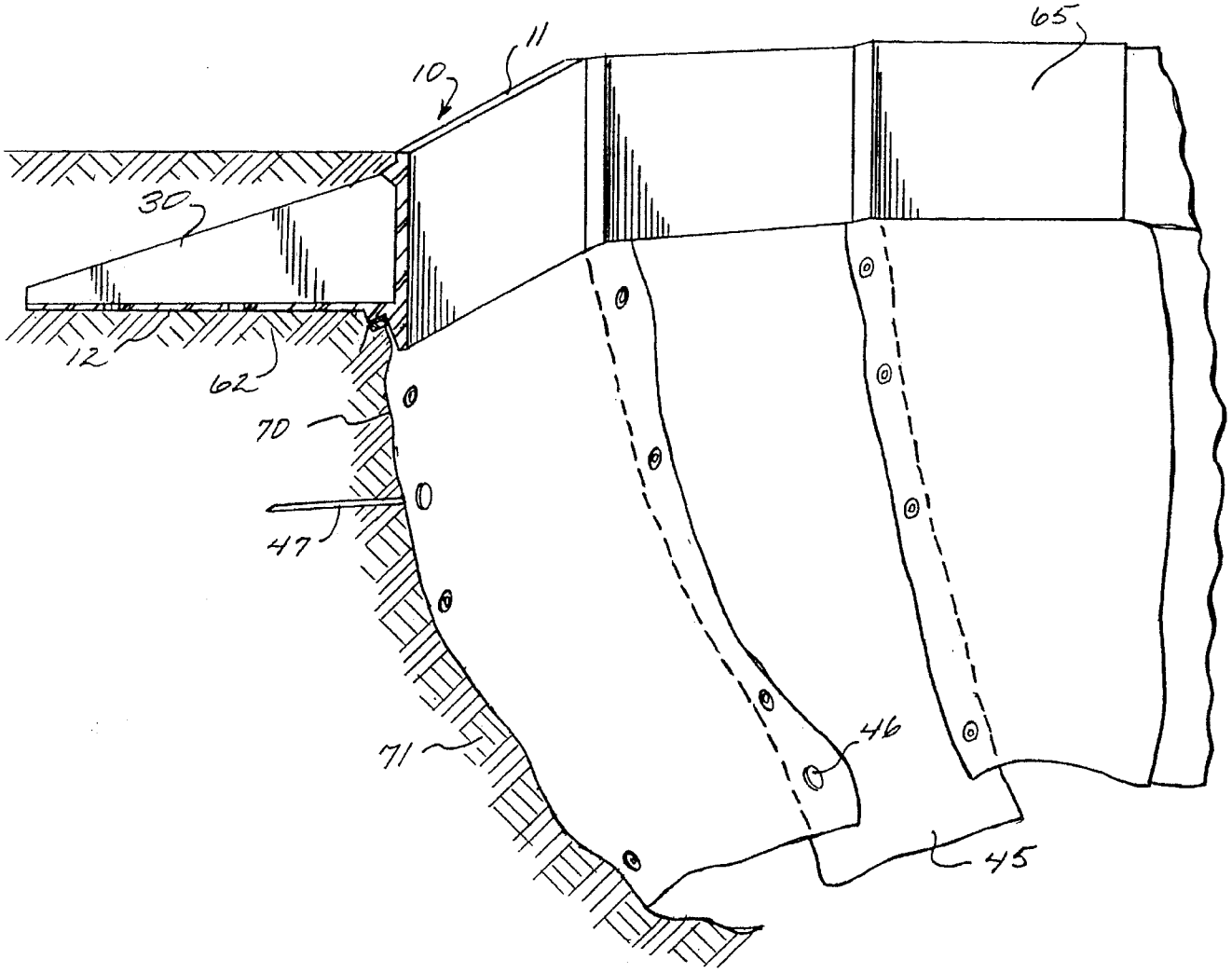
FIG. 7 is a rear perspective view of several retainer modules installed by the method of the present invention and shown after the back fill and excavation steps are completed and after the earth retainer blanket has been placed and secured.

Grommets 46 made of brass, plastic or other suitable material are provided along the perimeter of the retainer blanket 45 as fastening aids. The grommets are strategically positioned such that anchoring devices 47, such as spikes, nails or rods, may be used to secure the retainer blanket within the excavation. As shown in FIG. 7, the retainer blankets for each retaining module 10 can overlap each other and be pinned in common with shared anchoring devices. Each earth retainer blanket is clamped to the retaining module by means of a blanket batten 50 having screws 51, or may be secured by some similar device.

As shown in FIG. 3, vertical beam 11 or horizontal beam 12 may be provided with holes 52 for receiving a threaded insert (not shown) or may be molded or bored with threads for receiving the batten screws 51. In addition, the beams may be molded to form a blanket securing means such that the blanket is threaded into and secured within the module. Further, some applications may be facilitated by securing the retainer blanket 45 to the underside of the horizontal beam by means of the pinning holes 40 and the anchoring devices 47. In such applications, the horizontal beam and the retainer blanket are secured in place by the same means.

Referring again to FIG. 5, a liner 25 made of plastic, rubber or other watertight material is secured over the retainer blanket 45 and to the retaining module 10. In addition, a plastic or other flexible lathe material 55 can be attached over the liner and clamped to the vertical beam land 17 by means of the liner batten 26 and screws 27 so as to extend over the top of the vertical beam 11 and into the water area as far as desired. The lathe material should be water inert so as to provide a rigid base for the application of coatings or protective materials. For example, a suitable lathe material is made from high density polyethylene for use as an agriculture mesh and is available from Memphis Net And Twine, of Memphis, Tenn. As is well known in the art, the lathe material may be covered with glass reinforced concrete, plaster or other protective coatings 56, which can be made to look like real rock or soil.

The lathe material 55 is a base structural non-biodegradable plastic fabric of very course weave. The space between the weaves is typically at least 0.25 inches square. The lathe material is configured so that a protective coating 56 may be applied between, on and around the weave of the fabric. Thus, the lathe material will hold the coating in place while the fluid material cures and becomes hard and rigid. The cured coating thereby forms a protective and ornamental layer or shield over the liner and lathe material. Hence, the lathe is used for the protective coating's construction and reinforcement. The use of the lathe material in this manner is similar to the process where stucco is applied to a metal lathe of paper backed poultry wire.

Figure 8:
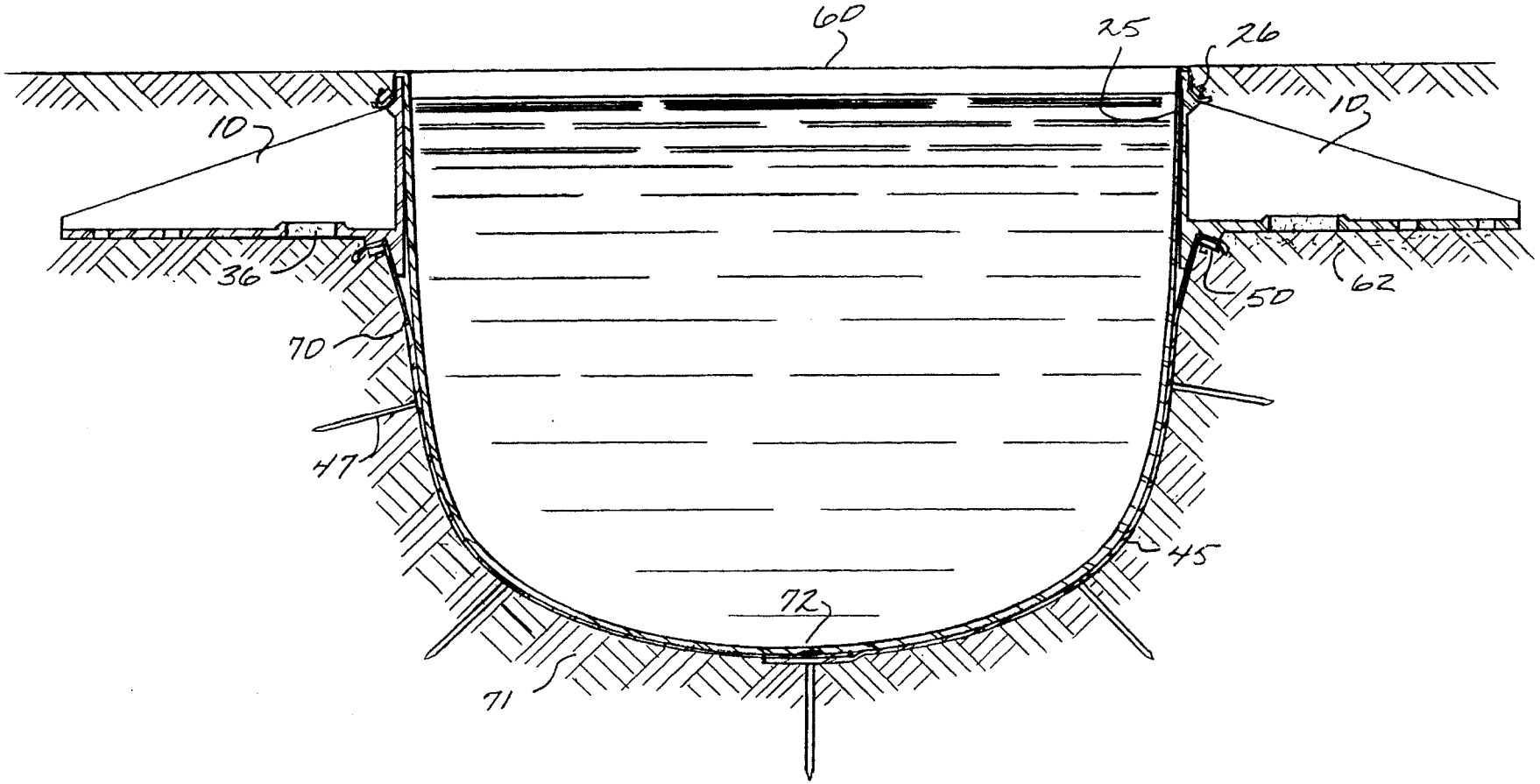
FIG. 8 is a sectional view of a completed installation utilizing the retaining modules and method of the present invention.
Figure 9:
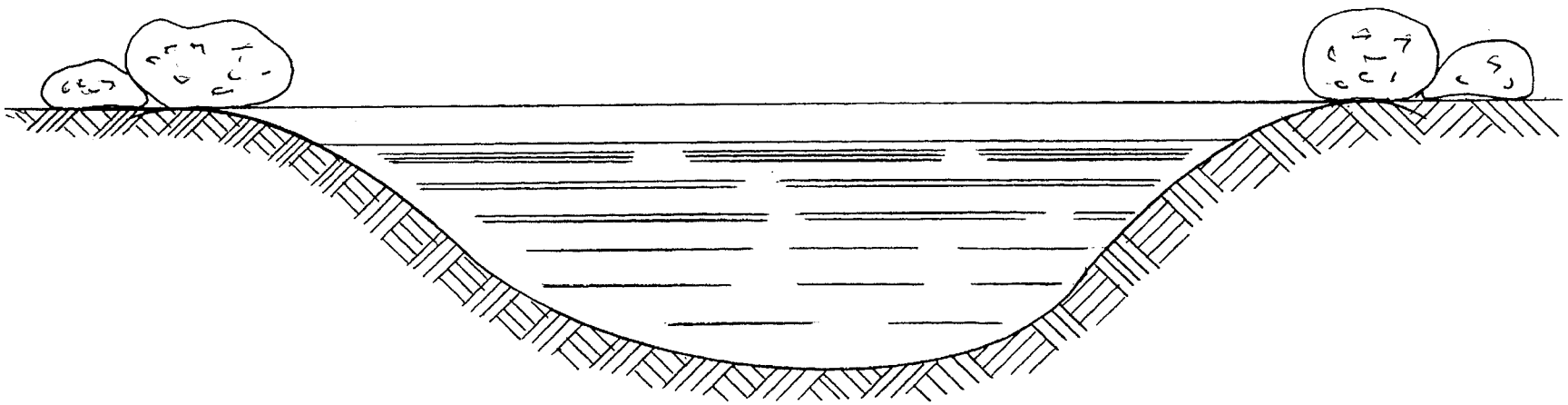
PRIOR ART FIG. 9
FIG. 9 illustrates a known method for constructing a liner pond.

By way of example, a finished koi pond is shown in FIG. 8. To construct such a pond, the perimeter of the pond is first marked on the ground to form a pond edge line 60. The lowest elevation around the pond edge line will determine the elevation of the top of the pond. Using this top of pond elevation point as a reference point, a trench 61 is excavated around the outside perimeter of the pond for the retainer modules 10 to be installed. The trench should be wider and deeper than the dimensions of a retaining module, for example, approximately 20 inches wide and 10 inches deep for a 16 inch by 8 inch retaining module.

As shown in FIG. 6, a trench base 62 is provided for the retaining module 10 by pouring a mixture of dry masonry sand or decomposed granite and dry cement into the trench 61. Because the bottom end 15 of the vertical beam 11 extends below the horizontal beam 12, the trench should be excavated somewhat deeper near the pond edge line 60.

Prior to placing each retaining module 10 in the trench 61, a retainer blanket 45 is attached to the retainer module in the manner described previously herein. The retainer blanket is temporarily folded over the outside face 65 of the vertical beam 11 and rolled to position the retainer blanket above the retaining module, as shown in FIG. 6. The retaining module and retainer blanket are then placed in the trench so that the horizontal beam 12 is positioned relatively level. Long nails or spikes 67 may be driven through some of the pinning holes 40 in the horizontal beam to hold the retaining module level and secure.

Each retaining module 10 is similarly secured within the trench 61, until the entire pond edge line 60 is enveloped with the retaining modules and retainer blankets 45. The level of each retaining module should be checked with reference to the first retaining module installed to ensure that each horizontal beam 12 is at approximately the same depth and that each vertical beam 11 is perpendicular to the pond edge line. To level and secure the retaining module, the holes 36 in access slots 35 may be used to pack additional dry sand/cement mixture under the horizontal beam and into the area where the vertical beam and retainer blanket join the horizontal beam.

There are applications of the present invention when a step or steps are desired to be installed into the pond. In such applications, the downward vertical side of the pond is sharply interrupted by a flat horizontal shelf area which returns sharply to the vertical wall. The horizontal shelf provides a surface for placing certain types of potted plants before the pond becomes deeper for the koi.

After the horizontal beam 12 is properly positioned, aligned, leveled and pinned; fill material, such as sand, soil and concrete, can be packed under the horizontal beam by passing the fill material through the access slots 35 provided in the horizontal beam. For additional support, post holes may be dug through access holes 36 and concrete poured through the access slots. The installation is made more structurally sound by excavating post holes down and away from the pond for a distance of a foot or two. Some concrete should extend up and through the access holes, overlapping the raised rim 37. In addition, concrete can be filled through the access slots to a level above the horizontal beams and monolithically poured to adjacent retainer modules 10. The concrete should have the same chemical composition and the same physical properties and degree of cure as adjacently poured concrete. As a result of the concrete being poured over the horizontal beams, the individual retainer modules will be more securely pinned and tied together in place. Once the composite beam consisting of the individual retainer modules is installed, the trench 61 is backfilled with the excavated earth and compacted so as to be substantially flush with the surrounding grounds.

The earth is then excavated on the pond side of the retaining modules. As shown in FIG. 8, the vertical wall 70 of the pond may be extended down at least an additional 18 inches. Below the vertical wall, a gradual angle should be excavated to cause the floor 71 of the pond to slope down towards the center or toward the drain or sump area 72 of the pond. For koi ponds the floor should taper to a bottom collection point where water and debris can be pumped out or drained out. For water gardens, a flat floor is often preferred, since a flat surface allows easier positioning of potted water plants.

Once the excavation is complete, the earth retainer blankets 45 are unrolled and overlapped over each other, as shown in FIG. 7. A series of grommets 46 are provided on the retainer blankets to anchor them to each other and to the pond wall 70, 71, 72. Heavy duty stakes, earth screws or similar anchors 47 are used to hold the retainer blankets in place. The retainer blankets provide extra protection to the liner 25 from sharp objects or other in-ground physical damage. As is well known in the art, certain compositions of polyester deter and repel rodents. One of the biggest potential problems encountered with using liners is the possibility of rodents chewing into the liner and breaching the seal of the pond. Thus, incorporating a polyester or similar retainer blanket into the wall of the pond also enhances the integrity of the pond wall by serving as a barrier to rodents.

With the retainer blankets 45 firmly secured, the watertight liner 25 is placed in the pond excavation and properly positioned. Once water is added inside the liner, it will subsequently lay flat against the pond wall 65, 70, 71, 72, as shown in FIG. 8. As described previously herein, the liner is then secured to the lands 17 of vertical beams 11 with the liner battens 26 and screws 27. If applicable, a protective shield or plastic lathe material 55 is clamped over the liner and a protective coating or decorative material 56 is applied.

An alternative configuration of the earth retainer beam module 77 is shown in FIGS. 10–13. The construction consists of a separate vertical beam 76 being rigidly fastened to a separate horizontal beam 75. A two-piece construction of similar sheets or plates enables much easier handling and less expensive shipping costs from the manufacturing process to the final customer delivery. The beams are constructed of high density polyethylene plastic type LS 4040-00, for example, that manufactured by Quantum Chemical Corporation of Cincinnati, Ohio. The retaining module 77 may be used as previously described herein for the retaining module 10.

Figure 10:
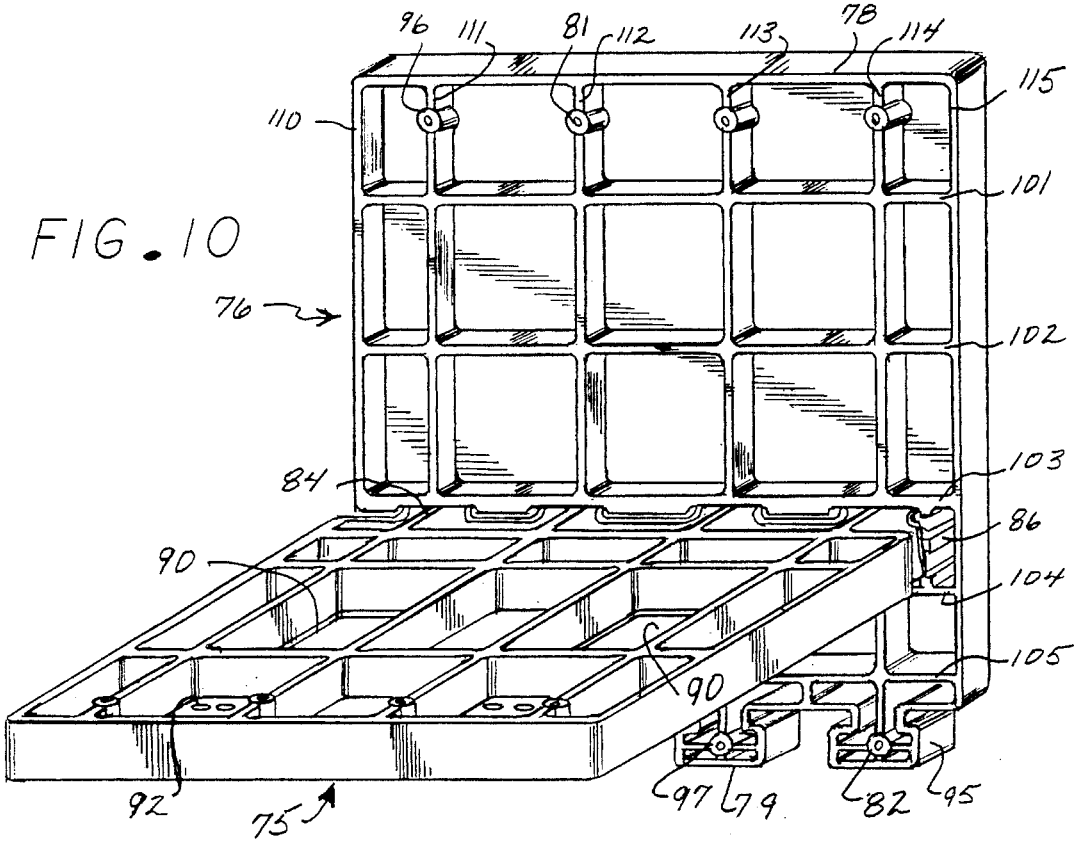
FIG. 10 is a front perspective view of an alternate embodiment of the retaining module of the present invention.

Referring to FIG. 10, the alternative method of beam module construction has a separate vertical beam 76 and horizontal beam 75 which comprise the retaining module 77. The configuration of the rectangular sheets or plates preferably includes a solid flat side and a side containing reinforcing ribs or gussets. The beams are substantially identical with certain exceptions and may be separately molded from the same mold. As is commonly known in the art of structural foam molding, metal tool inserts can be interchanged within one of the two mating manufacturing molding tools to allow slight design modifications. The beam construction process may use metal inserts to selectively mold holes in the manufactured rectangular sheets. The vertical beam will be molded without holes and the horizontal beam will be molded with holes using the inserts.

For example, the overall dimensions of the molded beams 75 and 76 is preferred to be sixteen inches wide by eighteen inches deep and 1.5 inches thick. The average range of material thickness in any given part is about a 0.18 inch minimum to a 0.35 inch maximum. Typical construction thicknesses in this embodiment is about 0.25 inch plus or minus 0.02 inch. The preferred tolerances are also preferably plus or minus 0.02 inch. However, the fit tolerances for the later described snap fit are plus or minus about 0.01 inch. For ease of molding, the corners and edges are rounded with a radius ranging from 0.06 inch to 0.13 inch.

The specific or structural geometric configuration of the vertical beam 76 is a solid 0.25 inch thick flat side sixteen inches wide by eighteen inches deep. The overall perimeter of the sheet or plate when viewed from the ribbed side consists of a 0.25 inch thick walls. The beam may be rectangular at the top with rounded corners; however, other shapes and sizes of the plate may be used. There are five horizontal ribs 101, 102, 103, 104, and 105 of equal length and thickness, molded into the earth retainer beam module 77. The ribs are spaced from the top centerline of the top rib down a distance of about 3.5, 7.5, 10.5, 12.75 and sixteen inches. The bottom edge 79 the vertical beam is just less than eighteen inches down from the centerline of the top of vertical beam. When viewing the beam from the ribbed side all structural ribs, gussets, walls and molded hole walls are 0.25 inch thick.

Vertical ribs 111, 112, 113, 114 are molded into the ribbed side of the vertical beam 76. The vertical ribs are continuous from the top end 78 to the bottom end 79 of the rectangular plate. The centerline of the 0.25 inch thick vertical ribs from left to right as identified from the centerline of the left side wall 110 of the beam are preferably about 1.9, 5.9, 9.9, 13.9, and 15.9 inches to the extreme right side of the beam. Each vertical rib extends down about one inch from the top end of the vertical beam where a 0.25 inch diameter molded hole 81 is centered in a 0.5 inch diameter boss 96.

There are four holes 81 in the vertical beam 76. The depth of each hole is 1.25 inches. The purpose for the molded in holes is to provide a receptacle for self tapping screws. The screws are used to secure materials such as the liner to the retainer module 77. The equal length vertical ribs extend down to the third horizontal rib 103 and are interrupted at that point where the beam receiver compartments 83 consisting of snap fit receiver guides 87 and snap fit catch arms 86 are molded into the vertical beam.

Figure 13:
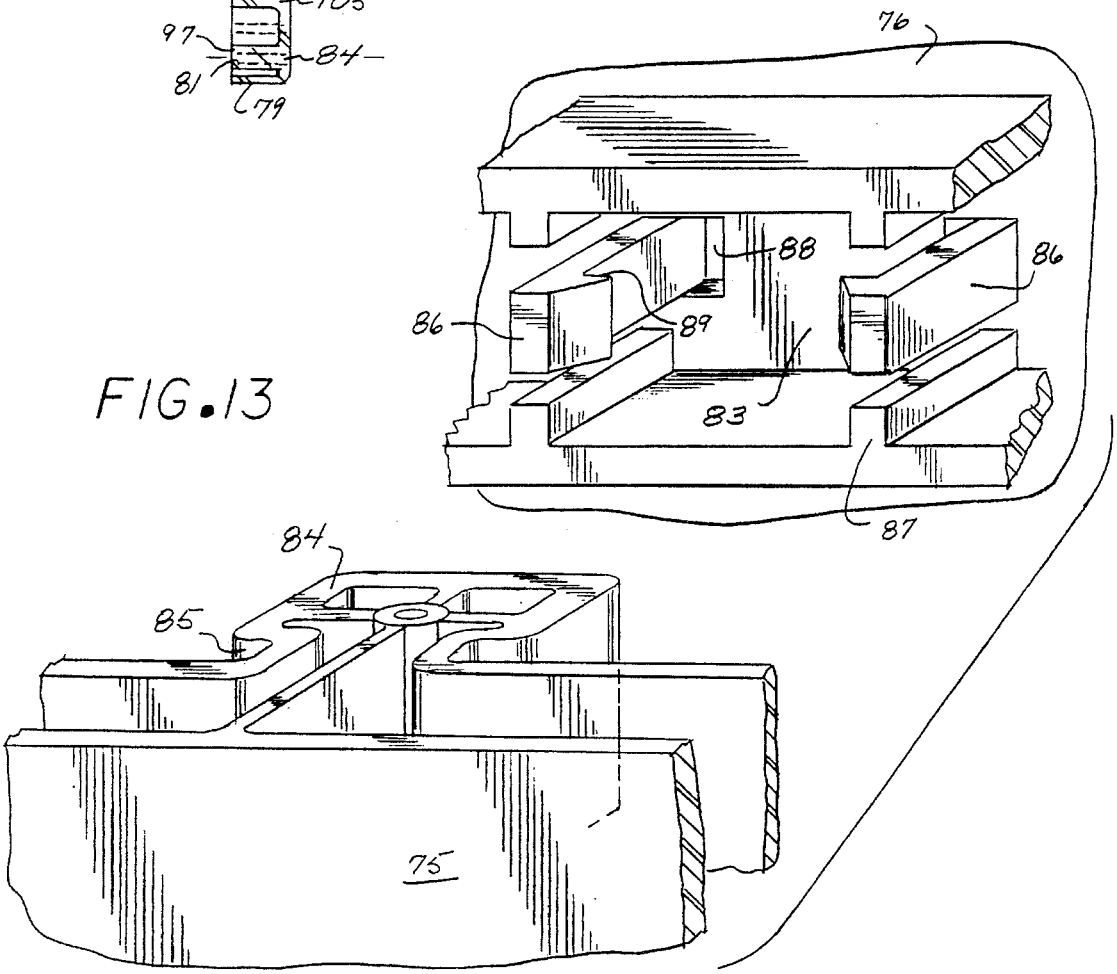
FIG. 13 is a perspective and partial sectional fragmentary view of the snap fit means used to secure the horizontal beam to the vertical beam of FIG. 10.

The purpose of the snap fit receiver guides 87 and snap fit catch arms 86 is to inexpensively and securely fasten the vertical beam 76 to an almost identical horizontal beam 75, utilizing a standard technique in the art known as a snap fit. As shown in FIG. 13, the beam receiver compartment 83 serves as the receiver part of the snap fit configured in the horizontal beam 75. The vertical beam has four substantially identical receiver compartments which are approximately two inches wide by 1.5 inches high and 1.25 deep into the vertical beam towards the front flat face of the vertical beam. The top of the receiver compartments are bounded by the third horizontal rib 103 and the bottom of the compartment is bounded by the fourth horizontal rib 104.

The vertical distance between the third and fourth horizontal ribs 103 and 104 is approximately 1.5 inches, which is slightly greater than the thickness of the part which will enter and fit into it. The vertical centerline of each receiver compartment 83 is co-linear with the centerline of each vertical rib 111, 112, 113, or 114 above and below it. Approximately one inch to the left and right of each vertical centerline is a top and bottom snap fit guide rib 87. The top vertical snap fit guides 87 extend down from the third horizontal rib 103 about 0.25 inch. Similarly, the bottom vertical snap fit guides 87 extend up from the fourth horizontal rib 3.04 about 0.25 inch. The snap fit guides 87 are also about 0.25 inch thick.

Each snap fit receiver compartment 83 is bounded by a left and right snap fit catch arm 86. Also, the snap fit catch arm is molded into the rectangular plate and extends 1.25 inches up from the inside face of the vertical beam 76. When viewed from the ribbed side of the vertical beam, the snap fit catch arm is 0.25 inch from bottom to top and varies in thickness from left to right. At the base of the snap fit catch arm, the thickness is 0.25 inch viewed from left to right. The thickness of the arm remains a constant 0.25 inch up from the inside face of the vertical beam for a distance of slightly less than 1.2 inches where the left to right distance of the snap fit catch area 86 steps out from 0.25 to 0.35 inch. This step change forms a bearing surface 89 that takes the load in each snap fit catch area if a force were to applied in a manner as to pull the vertical beam apart from the horizontal beam 75. The horizontal distance between the extreme inner sides of the diametrically opposite left and right snap fit catch arms 86 is approximately 1.8 inches.

The beam connector pilot 84 which fits into the snap fit compartment 83 is approximately 1.93 inches wide by 1.44 inches high and 1.13 inches deep. The snap fit catch beam 86 is sufficiently flexible to bend enough without failure in order to allow the entry of beam connector pilot 84 which fits into the snap fit receiver compartment 83. The beam connector pilot is uniform in width to a depth of about 1.13 inches where it necks down from 1.93 to 1.7 inches wide, creating the snap fit receiver groove 85.

During assembly of the retaining module 77, the snap fit catch arms 86 are elastically bent away from each other enough to allow the beam connector pilot 84 to be inserted into the beam receiver compartment 83. The beam connector pilot 84 spreads the pair of snap fit catch arms apart to the area of the receiver groove 85. The snap fit catch arms, by virtue of their elasticity, are retained in the beam connector pilot receiver groove, thereby securing the horizontal beam 75 to the vertical beam 76. In order for the two mold halves to separate during the manufacturing process it is necessary to provide a mold or tool extraction hole 88 in the receiver compartment.

Figure 12:
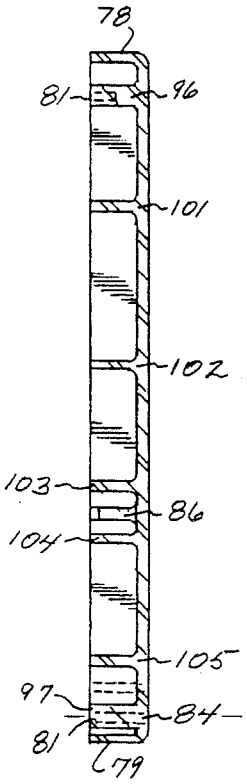
FIG. 12 is a cross-sectional view taken along the line 12—12 of FIG. 11.

The four vertical ribs 111, 112,113,114 of the vertical beam 76 resume their spacing down from the fourth horizontal beam 104 as previously defined from the top of the beam 78. Each of the vertical ribs have a 0.25 inch diameter hole 82 molded into a 0.5 inch diameter boss centered approximately 0.75 inch from the extreme bottom end 79 of the beam. As shown in FIG. 12, each of the four holes pass completely through the vertical beam.

There are four beam connector pilots 84 molded into the vertical beam 76 at the far bottom end 79 of the vertical beam. The vertical centerline of each of the beam connector pilots 84 are co-linear with the centerline of the four vertical ribs 111, 112, 113, 114. Viewed from the ribbed side of the vertical beam, each beam connector pilot is approximately 1.93 inches wide and 1.48 thick from the front face of the vertical beam. In other words the vertical beam thickness changes from a uniform 1.5 inches to 1.48 inches beginning a distance of 0.75 inch down from the fourth horizontal rib 104. A 0.25 inch thick short horizontal rib 95 centered co-linear with the horizontal axis of the four bottom 0.75 inch diameter holes 82 extends from the left and right of the 0.5 inch diameter hole bosses 97 to the vertical walls of the beam connector pilot.

Figure 11:
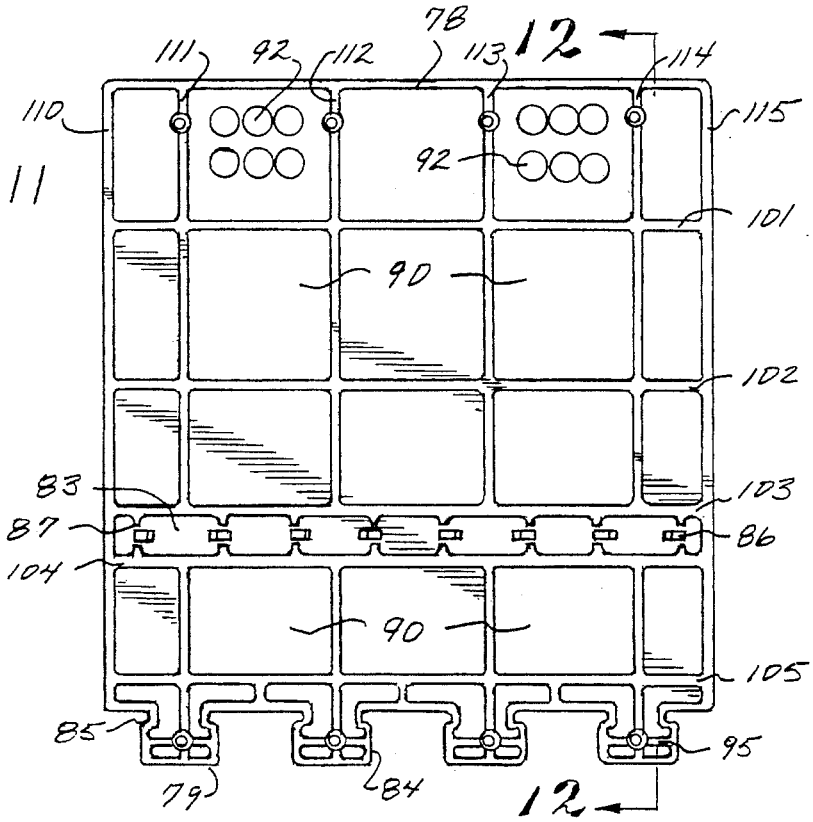
FIG. 11 is a top plan view of an embodiment of the horizontal beam of the retaining module of FIG. 10.

Referring to FIG. 11, the horizontal beam 75 may be configured substantially the same as the vertical beam 76. The horizontal beam also has four access holes 90 molded into the horizontal beam. The first access hole is located between the first horizontal ribs 101 and 102 and between vertical ribs 111 and 112. The second access hole is molded between the horizontal ribs 101 and 102 and between vertical ribs 113 and 114. The other two access holes are molded between horizontal ribs 104 and 105 at vertical ribs 111 and 112, and at vertical ribs 113 and 114.

In addition, a plurality of pinning holes 92 formed about 0.75 inches in diameter are molded into the horizontal beam 75 in two of the panels between the ribs. The first set of pinning holes is formed between the top horizontal perimeter 78 of the beam and horizontal rib 101 and vertical ribs 111 and 112. The second set of pinning holes is formed between the top horizontal perimeter 78 of the beam and horizontal rib 101 and vertical ribs 113 and 114. Two rows of three holes may be formed one inch apart, with each hole on the rows spaced about one inch apart.

While several particular forms of the invention have been illustrated and described, it will be apparent that various modifications can be made without departing from the spirit and scope of the invention. Accordingly, it is not intended that the invention be limited, except as by the appended claims.

What is claimed is:

1. A retaining module for forming a wall of a hole in the ground, said retaining module comprising:

a vertical beam having a first face and a second face, the first face being substantially flat;

a horizontal beam secured to the second face of said vertical beam, said horizontal beam having at least one access slot having a hole formed therein; and reinforcing means for securing said horizontal beam to said vertical beam, said reinforcing means including a plurality of connector pilots formed in said horizontal beam and a plurality of receiver compartments and catch arms formed in said vertical beam to form a snap fit securing device.

2. The retaining module of claim 1, wherein said horizontal beam further comprises pinning means including a plurality of holes formed in said horizontal beam.

3. The retaining module of claim 1, wherein said reinforcing means further comprises a plurality of elongate ribs.

4. The retaining module of claim 1, wherein said vertical beam further comprises fastening means including an elongated rectangular land.

5. The retaining module of claim 1, wherein each access slot is substantially oval in shape and has a raised rim forming a hole therein.

6. The retaining module of claim 1, wherein the fastening means of said vertical beam comprises a plurality of bosses formed with holes in the center of each boss.

7. The retaining module of claim 6, wherein each access slot is substantially rectangular in shape and has a raised rim forming a hole therein.

8. Apparatus for forming the wall of a hole formed in the ground, said apparatus comprising:

a first panel having first attachment means for securing a liner;

a second panel secured to said first panel and having at least one access slot having a hole formed therein;

a gusset secured to said first panel and said second panel for rigidly attaching said second panel to said first panel;

first pinning means for securing said second panel to the ground; and a retainer blanket secured to said first panel, said retainer blanket having second pinning means for securing said retainer blanket to the ground, wherein said first panel has second attachment means for securing said retainer blanket.

9. The apparatus of claim 8, wherein the first attachment means of said first panel comprises a land having a batten for securing a liner to the first panel.

10. The apparatus of claim 8, wherein said first pinning means comprises a plurality of holes formed in said second panel.

11. The apparatus of claim 8, wherein the second attachment means of said first panel comprises a land having a batten for securing said retainer blanket.

12. The apparatus of claim 8, wherein said second pinning means comprises grommets.

13. The apparatus of claim 8, wherein said first panel has at least two rectangular faces 8 inches wide and 10 inches long, and said second panel has at least two rectangular faces at least 8 inches wide and 10 inches long.

14. Apparatus for forming the wall of a hole formed in the ground, said apparatus comprising:

a first panel having ribs and having first attachment means for securing a liner;

a second panel secured to said first panel, said second panel having ribs and at least one access slot formed between the ribs;

a plurality of connector pilots formed in said second panel;

a plurality of receiver compartments and catch arms formed in said first panel to accept a connector pilot for rigidly attaching said second panel to said first panel; and first pinning means for securing said second panel to the ground.

15. The apparatus of claim 14, wherein said first pinning means comprises a plurality of holes formed in said second panel.

16. The retaining module of claim 14, wherein the first attachment means comprises a plurality of bosses formed in the ribs of the first panel, each boss having a hole formed therein for accepting a screw.

17. The apparatus of claim 14, further comprising a retainer blanket secured to said first panel, said retainer blanket having second pinning means for securing said retainer blanket to the ground, wherein said first panel has second attachment means for securing said retainer blanket.

18. The apparatus of claim 17, wherein said second pinning means comprises grommets.

19. The retaining module of claim 18, wherein the second attachment means comprises a plurality of bosses formed in the ribs of the first panel, each boss having a hole formed therein for accepting a screw.

20. The apparatus of claim 17, wherein said first panel has at least two rectangular faces 8 inches wide and 10 inches long, and said second panel has at least two rectangular faces at least 8 inches wide and 10 inches long.

21. System for constructing a pool, pond or stream formed in the ground, said system comprising:

a liner configured to conform to the shape of the pool, pond or stream, said liner being formed from substantially watertight and non-biodegradable material;

a vertical beam having a first face and a second face, the first face being substantially flat and forming a upper wall of the pool, pond or stream;

first attachment means for securing said liner to said vertical beam;

a horizontal beam secured to the second face of said vertical beam;

reinforcing means for rigidly attaching said horizontal beam to said vertical beam;

a plurality of access slots formed in said horizontal beam, each access slot having a raised rim forming a hole therein;

first pinning means for securing said horizontal beam to the ground; and a retainer blanket having second pinning means configured therein for securing said retainer blanket to the ground, wherein the retainer blanket is disposed between the liner and the ground so as to form a lower wall and a floor of the pool, pond or stream.

22. The system of claim 21, wherein said first pinning means comprises a plurality of holes formed in said horizontal beam.

23. The system of claim 22, wherein said second pinning means comprises a plurality of grommets formed in said retainer blanket.

24. The system of claim 23, wherein said reinforcing means comprises at least two gussets.

25. The system of claim 24, wherein said fittest attachment means comprises a land formed in said vertical beam and a batten for securing said liner to said vertical beam.

26. The system of claim 22, wherein said reinforcing means comprises a plurality of connector pilots formed in said horizontal beam, and a plurality of receiver compartments and catch arms formed in said vertical beam to form a snap fit securing device.

27. The system of claim 26, wherein the first attachment means comprises a plurality of bosses formed in said vertical beam, each boss having a hole formed therein for accepting a screw.

28. The system of claim 21, further comprising second attachment means for securing said retainer blanket to said vertical beam.

29. The system of claim 28, wherein said second attachment means comprises a land formed in said vertical beam and a batten for securing said retainer blanket to said vertical beam.

30. The system of claim 28, wherein the second attachment means comprises a plurality of bosses formed in said vertical beam, each boss having a hole formed therein for accepting a screw.

31. A method of constructing a pool, pond or stream in the ground, said method comprising the steps of:

(a) marking a perimeter of the pond;

(b) constructing a trench in the ground outside and adjacent to the perimeter of the pond;

(c) providing an retaining system including:

a vertical beam having a first face and a second face, the vertical beam further having first attachment means and second attachment means, a horizontal beam secured to the first face of the vertical beam and having at least one access slot having a hole formed therein, means for rigidly fixing the horizontal beam to the vertical beam, and a retainer blanket secured to the first attachment means of the vertical beam, the retainer blanket having means for securing the retainer blanket to the ground;

(d) securing the vertical beam and the horizontal beam within the trench so that the second face of the vertical beam forms an upper wall of the pool, pond or stream;

(e) leveling the horizontal beam by placing filling material in the access slot and under the horizontal beam;

(f) excavating the ground adjacent the vertical beam and within the perimeter of the pool, pond or stream to form a lower wall and a floor;

(g) covering the lower wall and the floor directly below retaining module with the retainer blanket;

(h) securing the retainer blanket to the lower wall and the floor;

(i) providing a watertight liner of sufficient size to cover the upper and lower walls and floor of the pool, pond or stream; and (j) using the second attachment means of the vertical beam to secure the liner so that the liner covers the retainer blanket and second face of the vertical beam.

32. The method of constructing a pool, pond or stream as recited in claim 34, said method further comprising the steps of:

(k) providing a plurality of retaining systems as recited in step (c);

(l) repeating steps (d) through (h) for each vertical beam, horizontal beam and retainer blanket; and (m) using the second attachment means of each vertical beam to secure the liner so that the liner covers each retainer blanket and the second face of each vertical beam.

(n) filling the trench over the retaining system such that the ground surrounding the pond appears natural and without noticeable remnants of the liner or retaining module.

33. A method of constructing an in-ground pond, said method comprising the steps of:

(a) constructing a trench in the ground to form the perimeter of the pond;

(b) providing a watertight liner for the pond;

(c) providing a retaining module including a vertical beam having attachment means for securing the watertight liner, the retaining module further including a horizontal beam secured to the vertical beam and means for rigidly fixing the horizontal beam to the vertical beam, the horizontal beam having at least one access slot having a hole formed therein, the horizontal beam further having a plurality of holes formed therein for securing the horizontal beam to the ground;

(d) providing a retainer blanket having means for securing the retainer blanket to the ground;

(e) placing the retaining module and the retainer blanket in the trench so that the vertical beam forms part of an upper wall of the pond, wherein the retainer blanket is secured to the retaining module;

(f) excavating the ground adjacent the vertical beam and within the perimeter to form a lower wall and a floor of the pond;

(g) covering the lower wall of the pond with the retainer blanket;

(h) securing the retainer blanket to the lower wall and floor of the pond;

(i) securing the liner to the earth retaining beam module, wherein the liner covers the vertical beam and the retainer blanket;

(j) providing a plurality of retaining modules as recited in step (c);

(k) repeating steps (d) through (i) for each retaining module;

(n) covering each vertical beam with a lathe material;

(l) covering the lathe material with a decorative coating; and (m) filling the trench to cover the horizontal beam of each retaining module.

34. The retaining module of claim 1, wherein said horizontal beam and said vertical beam are comprised of a structural foam.

35. The retaining module of claim 1, wherein said horizontal beam and said vertical beam are comprised of high density polyethylene.

* * * * *

UNITED STATES PATENT AND TRADEMARK OFFICE

CERTIFICATE OF CORRECTION

PATENT NO. : 5,489,165
DATED : February 6, 1996
INVENTOR(S) : David J. Smith

It is certified that error appears in the above-indentified patent and that said Letters Patent is hereby corrected as shown below:

Column 3, line 16, before "module", remove "7".

Column 4, line 13, "20" is a call-out and should be bold type.

Claim 7, column 11, line 15, change "6", to --1--.

Claim 20, column 12, line 15, change "17", to --14--.

Claim 25, column 12, line 53, change "fittest", to --first--.

Claim 32, column 13, line 48, change "34", to --31--.

Signed and Sealed this

Thirteenth Day of August, 1996

*Attest:*

Bruce Lehman

BRUCE LEHMAN

*Attesting Officer*

*Commissioner of Patents and Trademarks*